United States Patent [19]

Tsukamoto

[11] 4,057,988

[45] Nov. 15, 1977

[54] RECTIFYING EQUIPMENT OF BAR MATERIAL

[76] Inventor: Kotaro Tsukamoto, 7-8, Kashima 4-Block, Yodogawa, Osaka, Osaka, Japan

[21] Appl. No.: 714,961

[22] Filed: Aug. 16, 1976

[51] Int. Cl.[2] ..... B21D 3/04

[52] U.S. Cl. ..... 72/98; 72/99

[58] Field of Search ..... 72/98, 99, 100

[56] References Cited

U.S. PATENT DOCUMENTS 1,977,223 10/1934 Abramsen ..... 72/98

*Primary Examiner*—Lowell A. Larson

*Attorney, Agent, or Firm*—Wenderoth, Lind & Ponack

[57] ABSTRACT

An apparatus for straightening rod or bar-shaped material has a pair of end straightening devices spaced in the direction of the length of the material to be straightened and each having a pair of side-by-side rolls thereon, one having a convex roll profile and the other having a concave roll profile, and the axes of the rolls being oppositely inclined to the horizontal, and driving motors connected to the respective rolls for driving the rolls in the same rotational direction. At least three intermediate straightening devices are provided between the pair of end straightening devices and each having a guide horizontally slidably mounted for movement perpendicular to the direction between the end straightening devices, a supporter on the end of the guide which is adjacent the path of the material through the apparatus, and a straightening tube freely rotatably mounted with the supporter. The straightening tube has the shape of a nozzle with the larger end toward the direction from which the material to be straightened enters the apparatus and has a diameter at least slightly larger than the diameter of the material to be straightened. When the material to be straightened has larger curves therein, the guides can be horizontally adjusted for engaging the curved material as it is rotated by the end straightening devices for reducing the curvature thereof.

1 Claim, 4 Drawing Figures

RECTIFYING EQUIPMENT OF BAR MATERIAL

DETAILED DESCRIPTIONS ON RECTIFYING EQUIPTMENT OF BAR MATERIAL

The present invention pertains to straightening equipment, which is capable of efficiently straightening bar-shaped material from which to make shafting, etc. Conventionally, the bar material drawn into a desired diameter by a drawing machine has bends or curves due to the influence of production processing and other reasons. Therefore, to make the material into shafts, etc. having absolute straightness, it has to be processed by straightening equipment to have the bent or curved parts straightened. Thus far, it has been straightened by two straightening means spaced in the direction of the length of the material and each having two rolls, one convex and the other concave, which are forcibly driven. With this type of equipment, by the action of the convex and concave surfaces of the rolls the bent or curved parts of material are straightened while it passes between convex and concave rolls while being turned around. The rolls, however, are part of a fixed system and, therefore, the passing speed of material has to be adjusted according to the magnitude of curvature. When it is large, the length of material which can be handled has to be adjusted at a cost of many hours of labor. Thus, this equipment has a shortcoming from the standpoint of process control economy. The primary object of the present invention is to provide straightening equipment capable of supplementing the structural shortcoming of the conventional type of equipment and efficiently straightening curved material. The secondary object is to provide straightening equipment capable of perfectly processing the work at a fixed speed, whatever the magnitude of curvature may be, through an intermediate straightening means between the two conventional straightening equipment. With this intermediate device, the range of the straightening can be suitably adjusted to conform to the diameter or curving condition of the material.

These objects will be further understood from the attached drawings showing a specific example, and in which.

Figure 1:
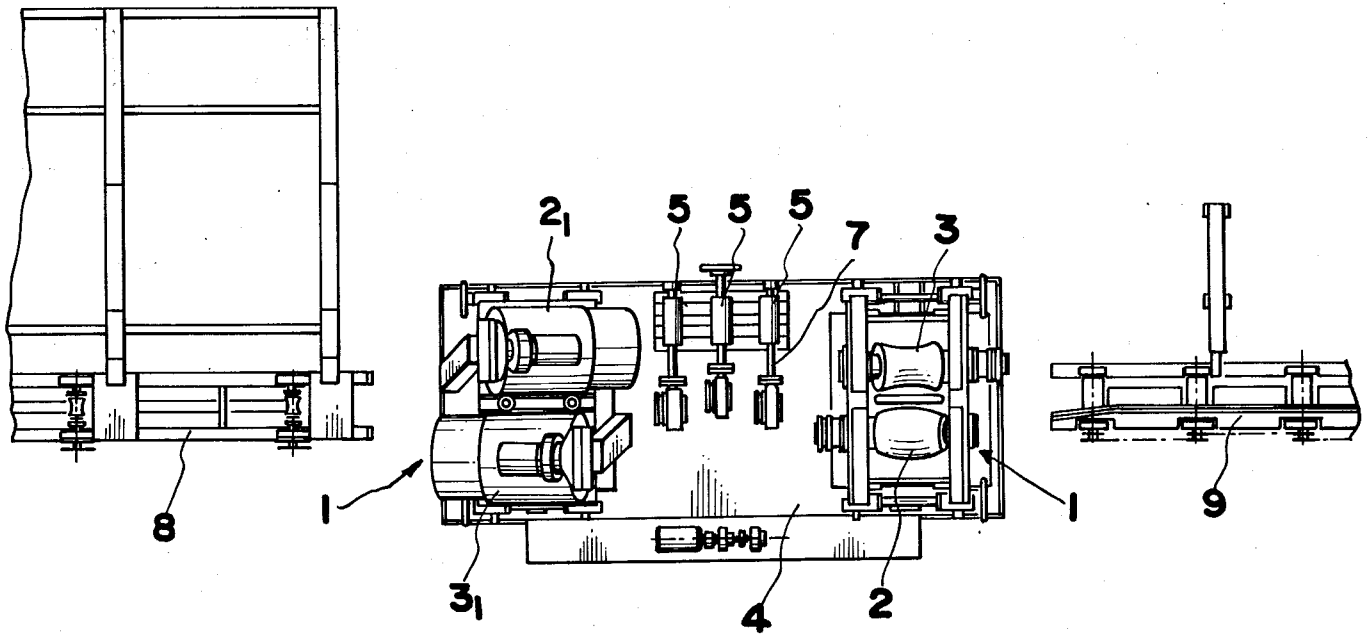
FIG. 1 is a plan view showing the invention in place in a material handling line.
Figure 2:
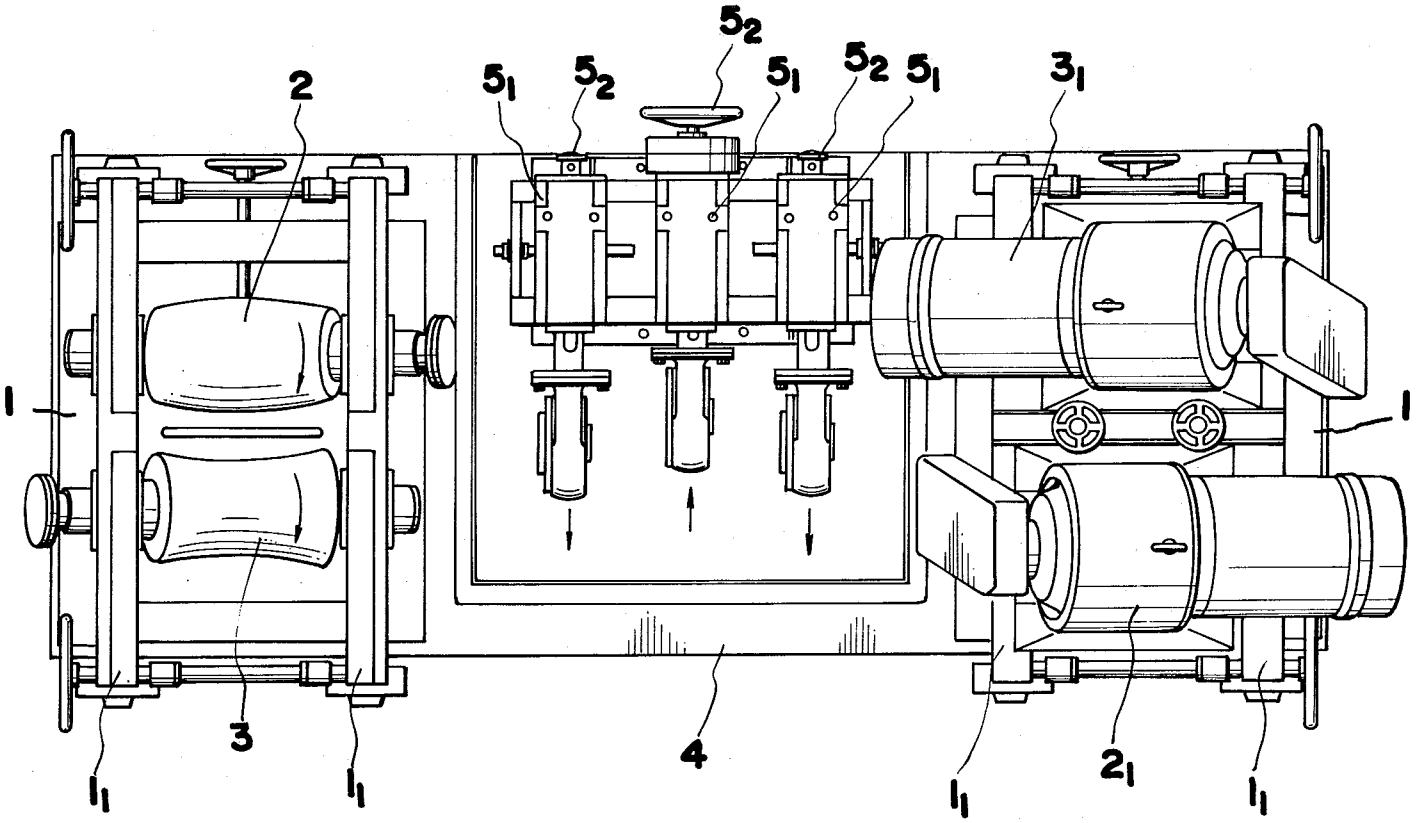
FIG. 2 is a plan view of only the apparatus of the invention, with a part on the left side removed.
Figure 3:
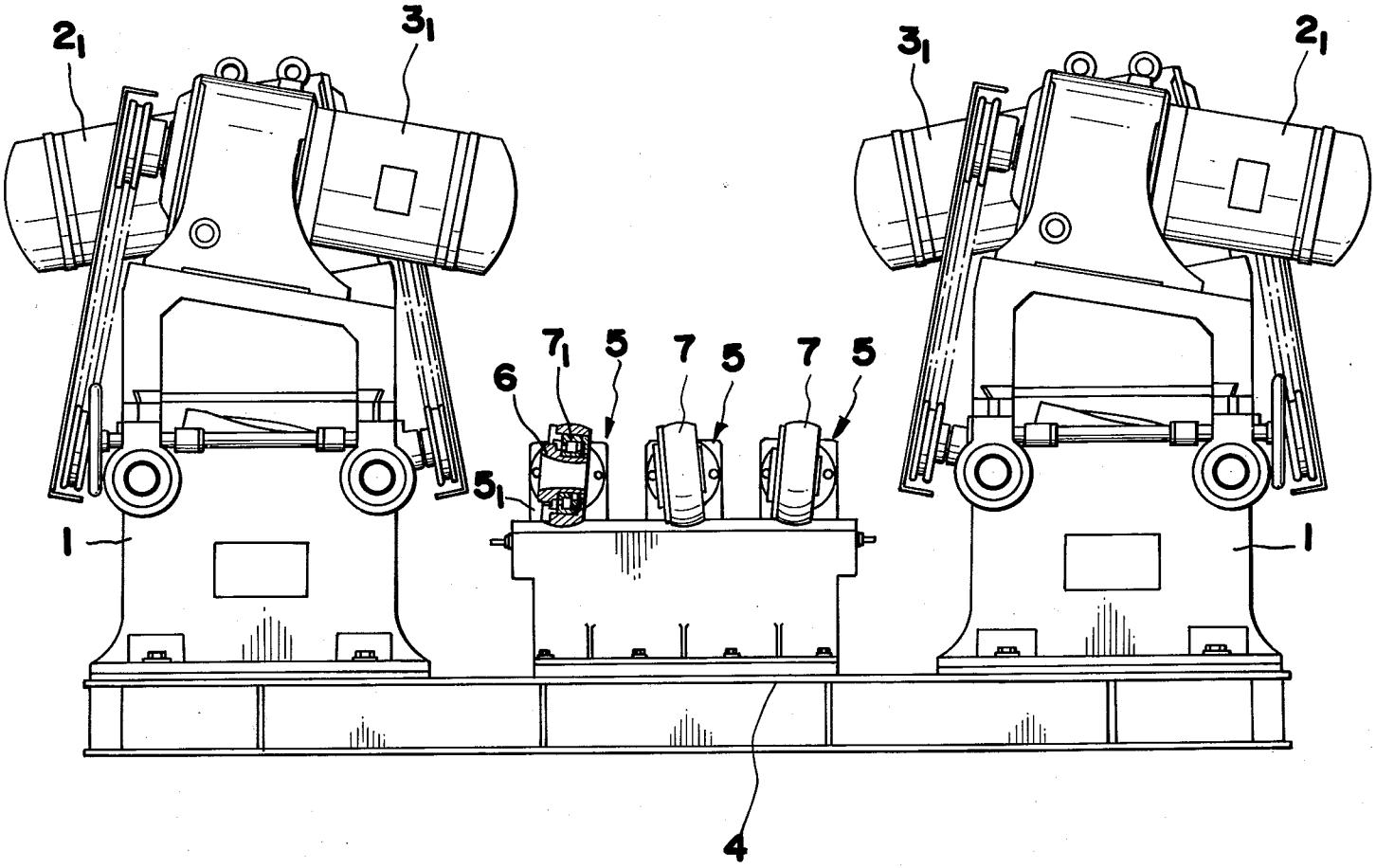
FIG. 3 is an elevation view of the apparatus of FIG. 2.
Figure 4:
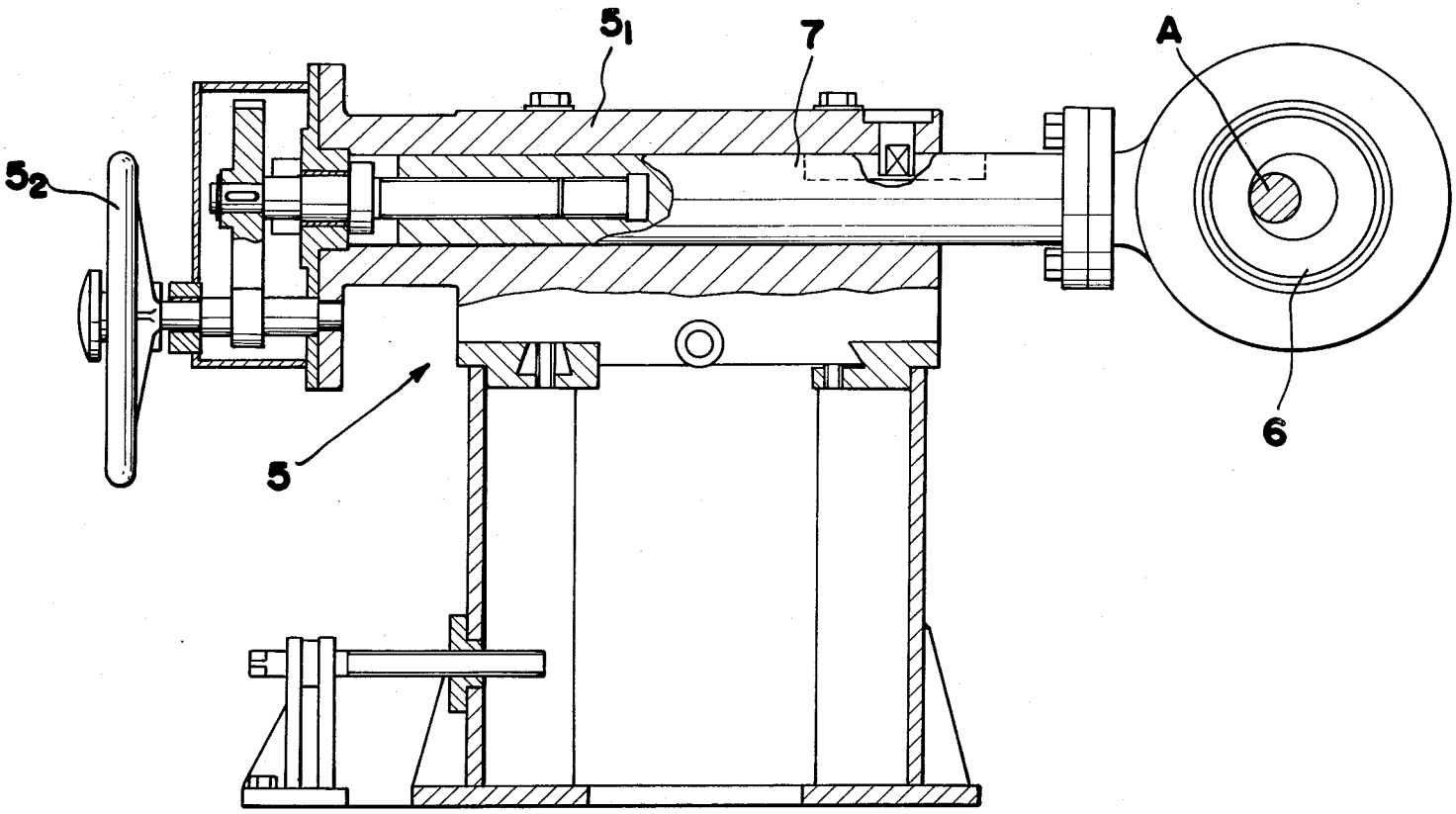
FIG. 4 is a longitudinal section of an intermediate device.

To begin with, side by side on each of the machine frames (1) between frame portions (1), are freely rotatably mounted two rectifying rolls, a convex roll 2 and a concave roll 3, the axes of which are parallel in plan view and at opposite inclinations in elevation view, said rollers being driven in the same direction driven by motors $2_1$ and $3_1$ mounted above the rollers through drive pulleys $2_2$ and $3_2$, and the bar of material, while passing between the rolls and being rolled thereby, has bent or curved parts thereof straightened as in conventional type equipment. Frames 1 are mounted on both ends of the machine bed 4.

A plurality of guides 5 are mounted horizontally in guide mounts $5_1$ and are freely movable horizontally, and each has a supporter 7 on the free end thereof holding a nozzle-shaped straightening tube 6 in a bearing 7, and through which the rod material is inserted. The horizontal position of each supporter 7 is adjustable by means of the handle $5_2$. Three such guides 5 are provided on the central part of the machine bed 4. As shown in FIG. 1, a conveyor line 8 for feeding the rod material into the straightening apparatus and a line 9 for conveying rod material away from the apparatus are provided ahead of and behind the bed 4.

The use and actions, as well as the effect, of the apparatus of the present invention will now be described.

When bar material to be straightened is fed into the first and second straightening means on frames 1 by the conveyor (8), it is frictionally engaged by rolls 2 and 3, turning in the same direction, and the rod material (A) is forcibly turned around, and by the convex roll and the concave any large curvature of the material is changed into a small curvature and it is delievered from the straighten equipment 1 at its outlet. When the bar material has only small curves, it is merely processed through the first and second straightening means on frames 1 at a fixed speed, and a rod material serviceable for the desired product can be obtained even in the absence of the guides 5. But in the case of a large curvature in the bar material, since the straightening equipment 1 is devoid of any mechanism to regulate the roll curvature to conform with that of the rod material, the speed of material passing through the apparatus has to be drastically reduced. Accordingly, in this instance the rod materials from the first straightening means are inserted through the straightening tubes 6 of the guides 5, and by regulating the horizontal position of the supporters 7 large curvatures are forcibly straightened and the rod material with minimum curvature is processed by the second, or final, straightening means for finishing the rod material to be used for the desired product, and this can be achieved without reducing the passing speed of the material. The straightening actions of the guides 5 and tubes 6. When rod material having a large curvature comes out of the first straightening means at a fixed speed, it is turning around a longitudinal axis, i.e, performing a so-called self-turning movement, and in the course of its passage through the first straightening tube 6 it repeatedly comes in contact with internal wall of the tube and its turning radius is reduced. The turning radius is further reduced by contact in the same way, with internal wall of the second and third straightening tubes 6: that is, the curvature is minimized. At this time, the horizontal positions length of the supporters 7 are adjusted by the handles $5_2$ so that the rod materials on the center lines of the straightening 6 remain in contact with the internal walls even if the turning radii are minimized. The rod material passing through the last straightening tube 6 has an extremely reduced curvature which can be completely removed by the final straightening means to provide bar material of due straightness, ready for the intended product.

As described above, according to the rod material straghtening equipment of the present invention the rolls 2 and concave rolls 3 are driven in the same direction, with one straightening means at each end of the machine bed 4 with which to straighten the rod material (A) passing between the two rolls. In addition in the center of the machine bed, at least guides 5 are provided which slide horizontally and at right angles to the rod material passing through the supporter 7: therefore even though the curvature of the rod material to be processed may be large, by merely adjusting the horizontal position of the straightening tube by the operation of the guide 5 the straightening can be achieved in a perfect way at a constant speed of passage without reducing such speed as is usual with the conventional type machines. Without regard to the diameter of curvature of the rod material, it can therefore be straightened in its desired unitary length and in about the same length of time, whereby the process is highly economical. Moreover the invention can be achieved by adding the intermediate guides to existing straightening equipment which can thus be utilized to advantage.

What is claimed is:

1. An apparatus for straightening rod or bar-shaped material, comprising a pair of end straightening means spaced in the direction of the length of the material to be straightened and each having a pair of side-by-side rolls thereon, one having a convex roll profile and the other having a concave roll profile, and the axes of said rolls being oppositely inclined to the horizontal, and driving means connected to the respective rolls for driving the rolls in the same rotational direction, and at least three intermediate straightening means between said pair of end straightening means and each comprising a guide horizontally slidably mounted for movement perpendicular to the direction between said end straightening means, a supporter on the end of said guide which is adjacent the path of the material through the apparatus, and a straightening tube freely rotatably mounted within said supporter, said straightening tube having the shape of a nozzle with the larger end toward the direction from which the material to be straightened enters the apparatus and having a diameter at least slightly larger than the diameter of the material to be straightened, whereby when the material to be straightened has larger curves therein, said guides can be horizontally adjusted for engaging the curved material as it is rotated by said end straightening means for reducing the curvature thereof.

* * * * *